US006953043B2

(12) United States Patent
Yu

(10) Patent No.: US 6,953,043 B2
(45) Date of Patent: Oct. 11, 2005

(54) RETRACTABLE DEVICE FOR SUN SHADING SUSPENSORY UMBRELLA

(75) Inventor: Fengming Yu, Zhejiang (CN)

(73) Assignee: Jianyong Xie, Zhejiang (CN)

( * ) Notice: Subject to any disclaimer, the term of this patent is extended or adjusted under 35 U.S.C. 154(b) by 47 days.

(21) Appl. No.: 10/608,526

(22) Filed: Jun. 30, 2003

(65) Prior Publication Data

US 2004/0055628 A1 Mar. 25, 2004

(30) Foreign Application Priority Data

Sep. 19, 2002 (CN) ..... 02260089 U

(51) Int. Cl.[7] ..... A45B 19/04; A45B 19/08; A45B 7/00

(52) U.S. Cl. ..... 135/20.1; 135/20.3; 135/21; 135/25.4; 135/98

(58) Field of Search ..... 135/20.1, 20.3, 135/21, 25.4, 25.1, 98

(56) References Cited

U.S. PATENT DOCUMENTS

D398,443 S * 9/1998 Bolle ..... D3/5
5,937,882 A * 8/1999 Harbaugh ..... 135/20.3
6,761,180 B1 * 7/2004 Lai ..... 135/20.3
2004/0182429 A1 * 9/2004 Chen ..... 135/15.1

* cited by examiner

*Primary Examiner*—Robert Canfield
(74) *Attorney, Agent, or Firm*—Birch, Stewart, Kolasch & Birch, LLP

(57) ABSTRACT

A retractable device of sun shading suspensory umbrella mainly comprises an upper and lower support umbrella rods, ribs and hand cranking device. The diameter of the upper support umbrella rod is less than the lower support umbrella rod. The upper umbrella rod is located within the low portion of the retractable device. The hand cranking retractable device is equipped within lower portion of the lower support umbrella rod. The hand cranking retractable device is a worm with a handle, which connects with an active worm gear and a driven worm gear separately on both sides. The active worm gear and driven worm gear separately connects to entwined wire rope first rotating wheel and second through axletree. One end of the first wire rope is wired to first rotating wheel. The other end is securely mounted to lower umbrella tray. One end of the first wire rope is wired to second rotating wheel, the other end of said second wire rope is securely mounted to upper support umbrella rods. The advantages include high performance of self-locking by adopting the worm gear and worm structure, and avoiding the phenomena of disengage and retroflexion in stretching the sun shading umbrella.

4 Claims, 3 Drawing Sheets

RETRACTABLE DEVICE FOR SUN SHADING SUSPENSORY UMBRELLA

FIELD OF THE INVENTION

The present invention relates to a retractable device for outdoor umbrella, and more particularly, to an improved retractable device of stretch and closure for large size sun shading suspensory umbrella used in a beach environment or the like.

BACKGROUND OF THE INVENTION

Owing to its huge panel and ribs, a conventional large size sun shading suspensory umbrella used in a beach environment or the like is difficult to control its stretch and closure, so it becomes the key point of using and the selection of umbrella. Various of stretch and closure structures of umbrella are available in the umbrella making field, but all existing structures of hand cranking device are in a model of ratchet and pawl. The solution of the stretch and closure structures of umbrella is mainly laid to frictional force. There are many defects in said existing structures, such as 1. frictional force is insufficient or not stable, resulting in disengagement or retroflexion in the stretching of sun shading umbrella; 2. frictional force made the abrasion of the parts, impacting its service life; 3. it is heavy and hard to stretch sun shading umbrella by cranking. 4. sometimes umbrella can not be complete contracted and closed by gravity. The present invention intends to provide a convenient stretch and closure structure of sun shading suspensory umbrella to overcome the disadvantages of conventional structure of umbrella.

SUMMARY OF THE INVENTION

In accordance with one aspect of the present invention, there is provided a retractable device of sun shading suspensory umbrella mainly comprising an upper and lower support umbrella rods, ribs and hand cranking device.

The diameter of said upper support umbrella rod is less than said lower support umbrella rod said upper umbrella rod is located within the low portion of said retractable device, said hand cranking retractable device is equipped within lower portion of said lower support umbrella rod said hand cranking retractable device is a worm with a handle, which connects with an active worm gear and a driven worm gear separately on both sides, said active worm gear and driven worm gear separately connects to entwined wire first to rope rotating wheel and second through axletree, one end of said first wire rope is wired to first rotating wheel, the other end is securely mounted to lower umbrella tray, one end of said second wire rope is wired to second rotating wheel, the other end of said second wire rope is securely mounted to upper support umbrella rods.

The advantages of the present invention are as follows: 1. The high performance of self-locking by adopting said worm gear and worm structure, not appearing the phenomena of disengage and retroflexion in stretching the sun shading umbrella; 2. Structure tightness, and less mechanical wear, long performance life; 3. Adopting structure of said one worm to drive two worm gears, it is even more convenient to stretch and close by external action, moreover cranking is easiness and labor saving; 4. Said support umbrella rods are composed by two arc-shaped support rods, so that it is rich in aestheticism and can stretch out and draw back freely.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENT

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
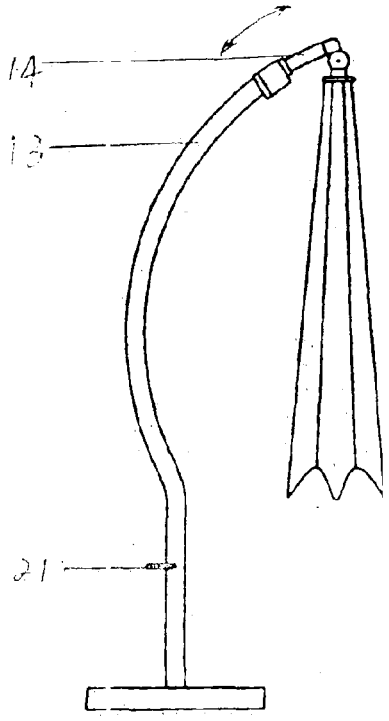
FIG. 1 is an illustrative view to show closure state of the umbrella of the present invention.
Figure 2:
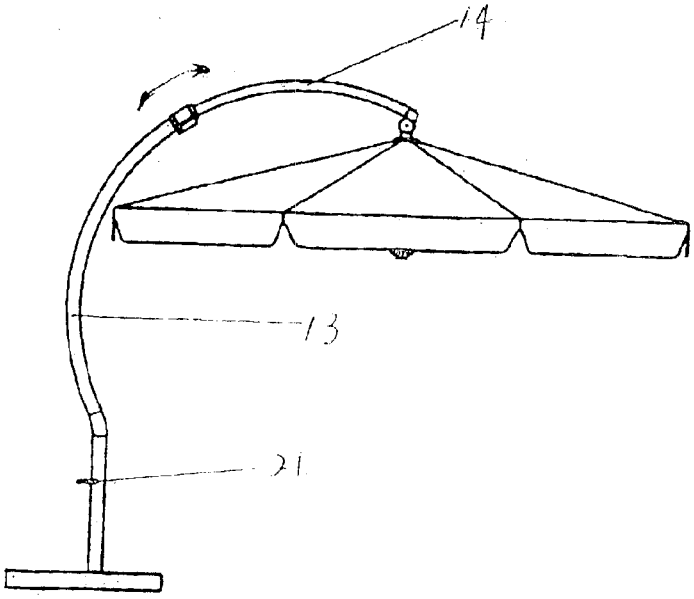
FIG. 2 is an illustrative view to show stretch state of the umbrella of the present invention.
Figure 3:
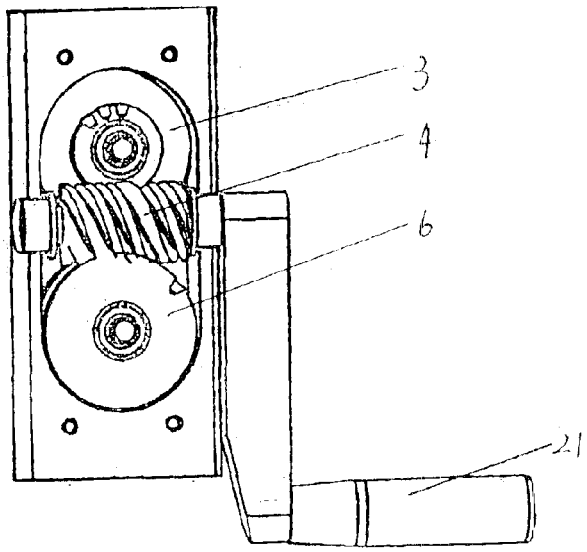
FIG. 3 is an illustrative view to show the structure of a hand cranking of the umbrella of the present invention.
Figure 4:
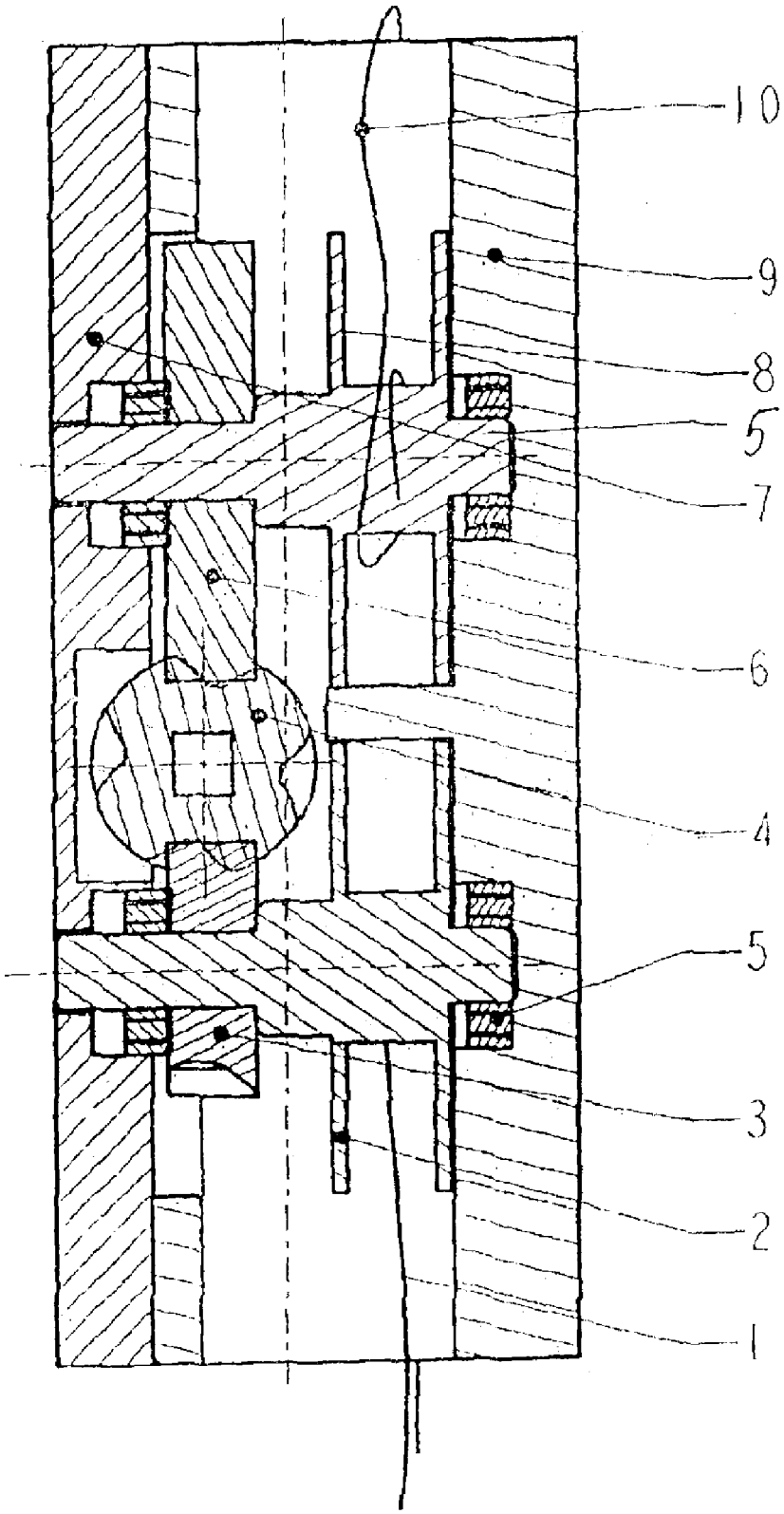
FIG. 4 is a sectional view to show the structure of a hand cranking of the umbrella of the present invention.
Figures 5, 6:
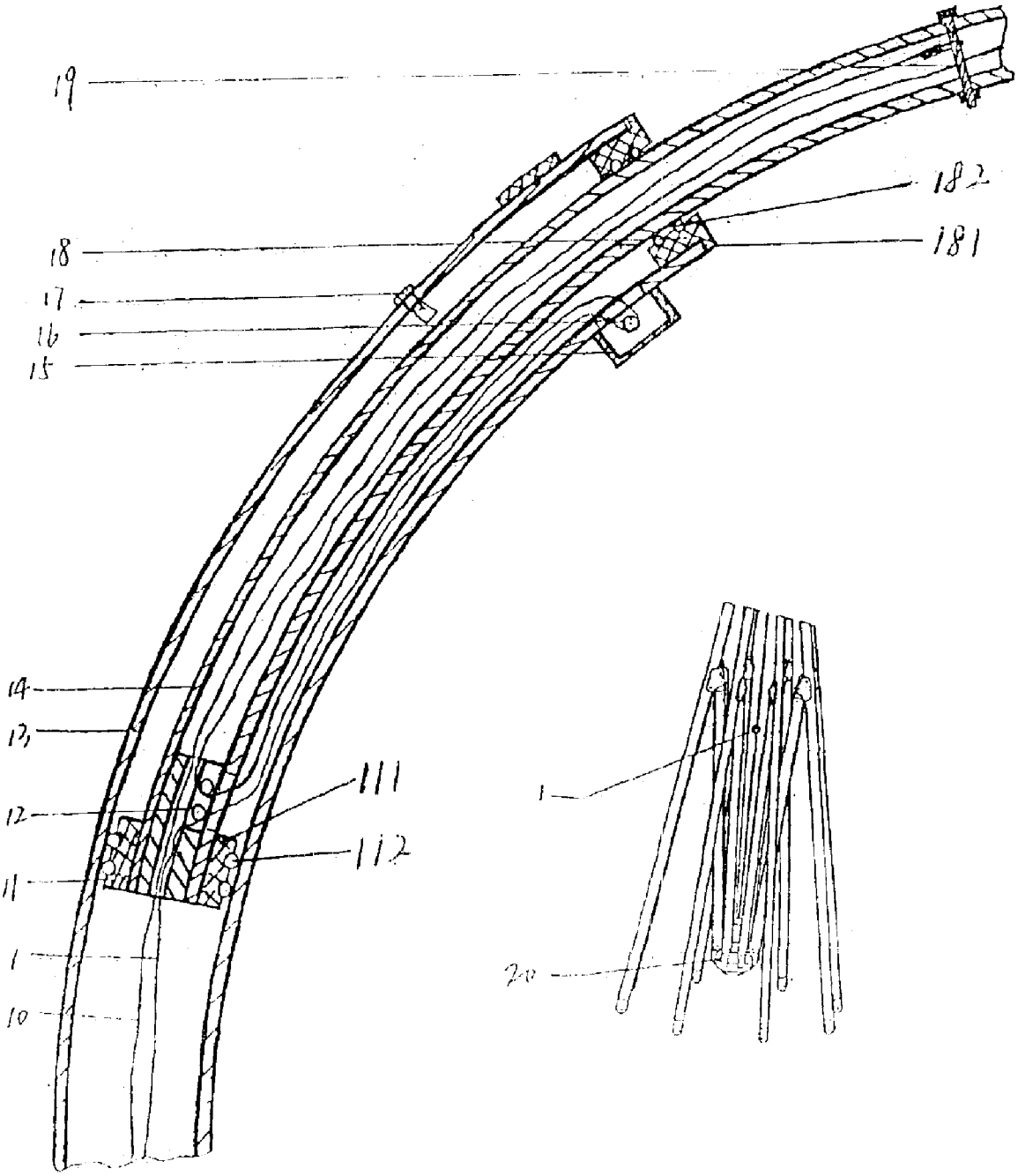
FIG. 5 is a sectional view to show the structure of upper and lower support umbrella rods.
FIG. 6 is an illustrative view to show the structure of ribs.

Referring to FIGS. 1 to 6, the retractable umbrella of the present invention comprises (1) second wire rope, (2) first rotating wheel, (3) active worm gear, (4) worm, (5) axletree, (6) driven worm gear, (7) capping, (8) second rotating wheel, (9) shell, (10) first wire rope, (11) upper support rod assistant slide device, (12) wire rope sheaves, (13) lower support umbrella rod, (14) upper support umbrella rod , (15) protective hood, (16) wire rope feed back pulley, (17) set bolt, (18) lower support rod assistant slide device, (19) wire rope fixed bolt, (20) lower umbrella tray and (21) handle.

The diameter of a cambered upper support umbrella rod (14) is less than a cambered lower support umbrella rod (13), upper support umbrella rod is located within the lower support umbrella rod (13) and is retractable. A assistant sliding device (11) is located in the lower part of upper support umbrella rod (14). Said sliding device (11) is composed of plastic sheath (111) and steel balls (112) which are evenly distributed to outside of the plastic sheath (111). Said steel balls (112) are able to roll, so that the frictional force may be decreased, when the said upper support umbrella rod (14) stretches out of lower support umbrella rod (13) and slides into lower support umbrella rod (13). There are three wire rope sheaves (12) within the lower portion of upper umbrella rod (14), so that the resistance force decreases when wire rope A1 is sliding; A assistant sliding device (18) is located within the upper portion of lower support umbrella rod (13), and the said sliding device (18) is composed of plastic sheath (181) and steel balls (182) which are evenly distributed to outside of the plastic sheath (181). There is a wire rope feed back pulley (16) located on external upper side of lower support umbrella rod (13) with a protective hood (15) outside, On the opposite side it has a set bolt (17).

Said hand cranking retractable device equipped with shell (9) and capping (7) locates within lower portion of the lower support umbrella rod (13), the said device is equipped with a worm (4) with a handle (21), the said worm (4) is separately connected an active worm gear (3) and a driven worm gear (6) on both sides, composing a structure of single worm driving two worm gears which are rotating in reverse directions. Said active worm gear (3) and driven worm gear (6) separately through axletree (5) connect to first rotating wheel (2) and second rotating wheel (8) of entwining second wire rope (1) and first wire rope (10), one end of second wire rope (1) is connected to first rotating wheel (2). The other end is securely mounted to the lower tray (20) of the bins, one end of first wire rope (10) is connected to second rotating wheel (8). The other end of first wire rope (10) is fixed on upper support umbrella rod (14), by bolt (19). The rotating speed of active worm gear (4) is twice of the driven worm gear. The length of entwined first wire rope (10) on the second rotating wheel (8) is half of the travel length of second wire rope (1) in the closure condition of umbrella.

When users want to use the umbrella, if need to open umbrella, clockwise cranking handle (21) connected with worm (4), drive active worm gear (3) and driven worm gear (6) rotates in reverse direction, resulting the connected first rotating wheel (2) and second rotating wheel (8) to rotate in reverse directions synchronistically, at this point second wire rope (1) set on the umbrella tray (20) starts to entwine on the first rotating wheel (2), at the same time first wire rope (10) originally entwined on the second rotating wheel (8) starts to release, at this movement through wire rope sheaves (12) and wire rope feed back pulley (16), second wire rope (1) stretches upper support umbrella rod (14) out of the lower support umbrella rod (13), up to set bolt (17), by now upper support umbrella rod (14) is completely stretched out of the lower support umbrella rod (13) and the panel is also at full length.

If need to close the umbrella, the users are only required to crank the handle (21) connected to the worm (4), driving active worm gear (3) and driven worm gear (6) to rotates in reverse direction, resulting the connected first rotating wheel (2) and second rotating wheel (8) to rotate in reverse directions synchronistically, by this time, first wire rope (10) on the bolt (19) which is fixed on the upper support umbrella rod (14) starts to entwine to the second rotating wheel (8), at the same time second wire rope (1) originally entwined on the first rotating wheel (2) starts gradually to release, the upper support umbrella rod (14) is retract back into lower support umbrella rod (13), plane will also close along with it, by now the length of the first wire rope (10) entwined on the second rotating wheel (8) is half of the whole travel length of the wire rope A, there is no entwined wire rope on the first rotating wheel (2), and it returns to its initial position.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A retractable device of a sun shading suspensory umbrella comprising:

upper and lower support umbrella rods, ribs, and a hand cranking device;

the diameter of the upper support umbrella rod being less that than the diameter of the lower support umbrella rod such that the upper support umbrella rod may slide within the lower umbrella support rod;

said hand cranking device equipped within a lower portion of the lower support umbrella rod;

said hand cranking device is a worm with a handle, said worm connects with an active worm gear and a driven worm gear separately on both sides;

said active worm gear and driven worm gear respectfully connect to a first rotating wheel and a second rotating wheel, a first wire rope having one end wired to the first rotating wheel and the other end securely mounted to a lower umbrella tray, and a second wire rope having one end wired to the second rotating wheel and the other end securely mounted to the upper support umbrella rod.

2. The retractable device of sun shading suspensory umbrella as claimed in claim 1, further comprising an assistant sliding device located in a lower part of upper support umbrella rod, said sliding device is composed of a plastic sheath and steel balls which are evenly distributed to outside of the plastic sheath, there are sheaves within the lower portion of upper umbrella rod.

3. The retractable device of sun shading suspensory umbrella as claimed in claim 1 further comprising an assistant sliding device located within an upper portion of lower support umbrella rod, and the said sliding device is composed of a plastic sheath and steel balls which are evenly distributed to outside of the plastic sheath, there is a wire rope feed back pulley located on external upper side of the lower support umbrella rod outside, on the opposite side it has a set bolt.

4. The retractable device of sun shading suspensory umbrella as claimed in claim 1 further comprising the rotating speed of active worm gear is twice that of the driven worm gear, the length of the first wire rope is half of the whole travel length of the second wire rope.

* * * * *